US009039031B2

(12) United States Patent
Soldan et al.

(10) Patent No.: US 9,039,031 B2
(45) Date of Patent: May 26, 2015

(54) FRONT RETAINING DEVICES FOR A GLIDING BOARD

(71) Applicant: SALOMON S.A.S., Metz-Tessy (FR)

(72) Inventors: Daniel Soldan, Seynod (FR); Matthieu Seris, Annecy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 13/945,402

(22) Filed: Jul. 18, 2013

(65) Prior Publication Data

US 2014/0021696 A1 Jan. 23, 2014

(30) Foreign Application Priority Data

Jul. 19, 2012 (FR) ..... 12 02057

(51) Int. Cl.
*B62B 1/00* (2006.01)
*A63C 9/00* (2012.01)
*A63C 9/08* (2012.01)

(52) U.S. Cl.
CPC ..... *A63C 9/003* (2013.01); *A63C 9/0807* (2013.01)

(58) Field of Classification Search
CPC ..... A63C 9/081; A63C 9/08; A63C 9/20; A63C 9/22; A63C 9/00; A63C 9/086
USPC ..... 280/620, 613, 11.31, 615, 616, 618, 280/614, 617, 619, 625, 631, 607, 626, 636
See application file for complete search history.

(56) References Cited

U.S. PATENT DOCUMENTS 2,130,693 A * 9/1938 Nashe et al. ..... 280/619
3,408,087 A * 10/1968 Ramillon ..... 280/631
3,907,319 A * 9/1975 Berlied, Jr. ..... 280/615
4,157,191 A * 6/1979 Ramer ..... 280/614
4,500,108 A 2/1985 Johnson, III
4,867,471 A * 9/1989 Stritzl et al. ..... 280/618

(Continued)

FOREIGN PATENT DOCUMENTS

DE 40 07 667 C1 6/1991
DE 10 2007 038 506 A1 2/2009

(Continued)

OTHER PUBLICATIONS

Search report from patent application EP 13 00 3555, dated Oct. 8, 2013.

*Primary Examiner* — Hau Phan
(74) *Attorney, Agent, or Firm* — Greenblum & Bernstein, P.L.C.

(57) ABSTRACT

A gliding apparatus includes a gliding board, a first front boot-retaining device for ascending a slope and a second front boot-retaining device for the descent. The first front retaining device comprises a first boot-fastening mechanism, defining a boot pivot axis during the ascent. The second front retaining device comprises a second boot-fastening mechanism, including a movable element incorporating an interface surface capable of contacting a front portion of the boot, the movable element being separate from the first fastening mechanism. The second front retaining device is configurable in a first "inactive" configuration for which the interface surface is away from the boot front portion, and a second "active" configuration for which the interface surface contacts the boot front portion. The first boot-fastening mechanism is capable of cooperating with the movable element of the second front retaining device so as to maintain the second front retaining device in its active configuration.

27 Claims, 8 Drawing Sheets

(56) References Cited

U.S. PATENT DOCUMENTS

| | | | | | |
|---|---|---|---|---|---|
| 5,056,810 | A | * | 10/1991 | Rigal | 280/625 |
| 5,249,820 | A | | 10/1993 | Burger et al. | |
| 5,338,053 | A | * | 8/1994 | Hauglin | 280/615 |
| 5,997,026 | A | * | 12/1999 | Klubitschko et al. | 280/607 |
| 6,467,796 | B1 | * | 10/2002 | Weltman et al. | 280/615 |
| 8,366,138 | B2 | * | 2/2013 | Korpua | 280/620 |
| 8,398,110 | B2 | * | 3/2013 | Morin | 280/614 |
| 8,439,389 | B2 | | 5/2013 | Moore et al. | |
| 8,544,869 | B2 | | 10/2013 | Lehner | |
| 2006/0022432 | A1 | * | 2/2006 | Cunningham et al. | 280/617 |
| 2011/0291386 | A1 | | 12/2011 | Marechal et al. | |
| 2013/0300089 | A1 | | 11/2013 | Barthel | |

FOREIGN PATENT DOCUMENTS

| | | | |
|---|---|---|---|
| EP | 0 199 098 | A2 | 10/1986 |
| EP | 0 620 029 | A2 | 10/1994 |
| EP | 1 438 993 | A1 | 7/2004 |
| EP | 2 399 654 | A1 | 12/2011 |
| FR | 2 172 925 | A1 | 10/1973 |
| FR | 2 567 409 | A1 | 1/1986 |
| FR | 2 945 185 | A1 | 11/2010 |
| WO | WO-2009/121187 | A1 | 10/2009 |

* cited by examiner

FRONT RETAINING DEVICES FOR A GLIDING BOARD

CROSS-REFERENCE TO RELATED APPLICATION

This application is based upon French Patent Application No. 12/02057, filed Jul. 19, 2012, the disclosure of which is hereby incorporated by reference thereto in its entirety, and the priority of which is claimed under 35 U.S.C. §119.

BACKGROUND

1. Field of the Invention

The invention relates to a gliding apparatus suited for the practice of ski touring.

2. Background Information

During the practice of ski touring, the binding securing the boot to the ski required in the ascent phase is functionally very different than in the descent phase. This translates into requirements, in terms of safety and strength of the binding, as well as the kinematics of the boot, that vary from one phase to the other. Thus, during the descent, the binding must ensure that the boot is properly retained on the ski, preferably with release of the binding in the event of a fall in order not to injure the skier. During the ascent, the boot should be enabled to rotate about a transverse axis, substantially at the front of the sole of the boot. Therefore, the boot is not immobilized in relation to the ski, and there is no need to release the binding during the ascent.

For the practice of ski touring, manufacturers have proposed various binding solutions including a specific boot front retaining device, or toe-piece, and a specific boot rear retaining device, or heel-piece.

A first solution is to adapt a binding designed for the descent. This binding is assembled on a rotatable plate that is released during the ascent phase and blocked during the descent phase. As a result, the same devices for retaining the boot are used for both the ascent and the descent. A disadvantage of this design is that, generally speaking, these retaining devices are relatively heavy to move during the ascent phase. Such bindings are described in the documents EP-A-1 438 993, DE-10 2007 038506, and EP-A-2 399 654.

A second solution is to adapt a binding designed for the ascent. In this case, the toe-piece is made lighter and incorporates a boot fastening mechanism defining an articulation axis about which the boot pivots during the ascent. During the descent, the boot is retained at the front by the same toe-piece and at the rear by a complementary heel-piece. The lateral release is generally carried out by the heel-piece. The design of the toe-piece must meet the retention requirements of the descent phase, which makes it complex and weighs down the device. These bindings are shown in the documents EP-A-0 199 098 and EP-A-2 300 111.

A third alternative solution proposes bindings having two separate toe-pieces, one being dedicated to the ascent and the other to the descent.

The document EP-A-0 620 029 describes a pivot bearing serving as the toe-piece for the ascent and a sole-clamp forming the toe-piece for the descent. The sole-clamp is comprised of a clamping yoke foldable between the ascent toe-piece and the rear retaining device. This solution implies that the descent toe-piece is to be housed beneath the boot during the ascent phase. Thus, this configuration requires the boot to be elevated in relation to the ski sole during the ascent. The elevational positioning of the boot is unfavorable for the skier's stability and supports.

The document FR-A-2 567 409 describes another variation incorporating a configurable front retaining device including a lever mechanism for alternatively activating an ascent toe-piece or a descent toe-piece. The descent toe-piece incorporates a lateral release mechanism, which weighs down the front retaining device. To activate one of the two toe-pieces, the mechanism causes the displacement of the toe-pieces, which makes it relatively complex. The activation of a toe-piece acts on the retraction of the other, and vice versa. The kinematics of the ascent toe-piece is complex in that the arms, comprising points cooperating with the sole to form the articulation axis of the boot, move both longitudinally and transversely (bringing the points closer together). The descent toe-piece rotates about an axis transverse to the ski. By design, the toe-piece extends vertically (90° rotation) when in the inactive position. This constraint is detrimental because it hinders the rotation of the boot during the ascent phase, as the boot can hardly turn beyond 45°, because the retracted ascent toe-piece limits this rotation. Therefore, this binding is not optimum for the ascent phase, in which the skier needs to turn the boot in relation to the ski by more than 65°. In the assembled configuration, the front retaining device is esthetically unattractive and bulky. In addition, it can cause injuries or accumulates snow, which can disrupt the operation of the lever mechanism.

SUMMARY

The invention provides a gliding apparatus equipped with bindings which solve the aforementioned problems.

In particular, the invention provides an improved gliding apparatus that makes it possible to optimize both the ascent and the descent.

The invention also provides a reliable gliding apparatus and, in particular, avoids the risk of losing binding elements.

Further, the invention facilitates the configuration of the gliding apparatus for the ascent or the descent.

Still further, the invention provides a switchable binding that is compact and easy to use.

The invention provides a gliding apparatus including a gliding board, a first front boot retaining device provided for ascending a slope, and second front boot retaining device provided for the descent. The first front retaining device comprises a first mechanism for fastening the boot, defining an articulation axis about which the boot pivots during the ascent. The second front retaining device comprises a second mechanism for fastening the boot, including a movable element incorporating an interface surface adapted to come into contact with a front portion of the boot, the movable element being separate from the first fastening mechanism. The second front retaining device is configurable according to a first configuration, so-called inactive configuration, for which the interface surface is away from the front portion of the boot, and a second configuration, so-called active configuration, for which the interface surface is in contact with the front portion of the boot.

The gliding apparatus provides that the first mechanism for fastening the boot is adapted to cooperate with the movable element of the second front retaining device so as to maintain the second front retaining device in its active configuration.

This construction makes it possible to obtain a gliding apparatus with two interchangeable and compact front retaining devices. The use of the fastening mechanism of the first retaining device is optimized because it makes it possible to actuate the first front retaining device, on the one hand, and to maintain the second front retaining device in the active configuration position. The ergonomics for locking the second retaining device in its active configuration is then simple and intuitive. Indeed, the user only needs to use one simple mechanism, namely the fastening mechanism of the first retaining device.

According to advantageous but non-essential aspects of the invention, such a binding may incorporate one or more of the following characteristics, taken in any technically acceptable combination:

- the movable element includes a retaining device arranged so as to be capable of cooperating with the retaining members of the first front retaining device when the second front retaining device is in its active configuration;
- the first mechanism for fastening the boot includes two fastening members movable transversely in relation to the gliding apparatus and adapted to cooperate with two lateral housings arranged on respective sides of the front portion of the boot sole. According to one embodiment, each fastening member is mounted on an arm that rotates or flexes about an axis parallel to the longitudinal axis of the gliding apparatus. Alternatively, the fastening members are only movable in the same plane transverse to the gliding apparatus;
- the retaining members are the fastening members adapted to cooperate with housings provided on the movable element;
- the retaining device and retaining members are dimensioned so that the first fastening mechanism releases the movable element when the first fastening mechanism is deactivated to release the boot;
- the first and second front retaining devices are continuously affixed to the gliding board;
- the movable element of the second front retaining device is rotationally and/or translationally movable;
- when the second front retaining device is in its inactive configuration, it is arranged so that the interface surface is positioned longitudinally forward of the gliding apparatus, in relation to the articulation axis, and so that no element of the second front retaining device hinders the rotation of the boot about the articulation axis, by an angle of at least 70°, from a position of the boot supported on the board, when the boot is retained by the first front retaining device;
- when the second front retaining device is in its inactive configuration, it is arranged at the rear of the gliding board in relation to the first front retaining device;
- when the second front retaining device is in its active configuration, the interface surface is positioned longitudinally in relation to the first front retaining device, so that no element of the first front retaining device interferes with a lateral release of the front portion of the boot;
- the first front retaining device is adapted to partially house the movable element of the second front retaining device;
- the movable element of the second front retaining device does not incorporate any mechanism for the lateral release of the front portion of the boot.

BRIEF DESCRIPTION OF DRAWINGS

Other characteristics and advantages of the invention will better understood from the description that follows, with reference to the annexed drawings illustrating, by way of non-limiting embodiments, how the invention can be embodied, and in which.

DETAILED DESCRIPTION

Figure 10:
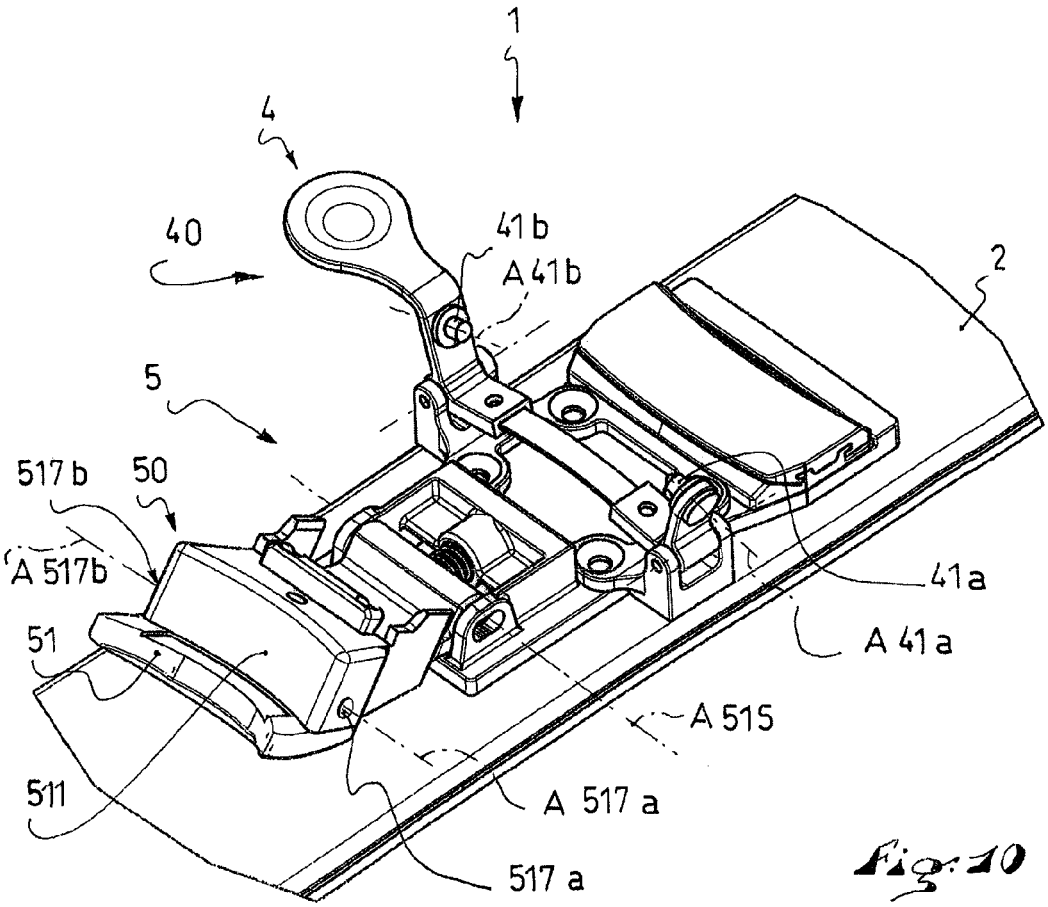
FIG. 10 is a perspective view of the front retaining devices of a gliding apparatus according to an alternative embodiment of the invention.
Figure 11:
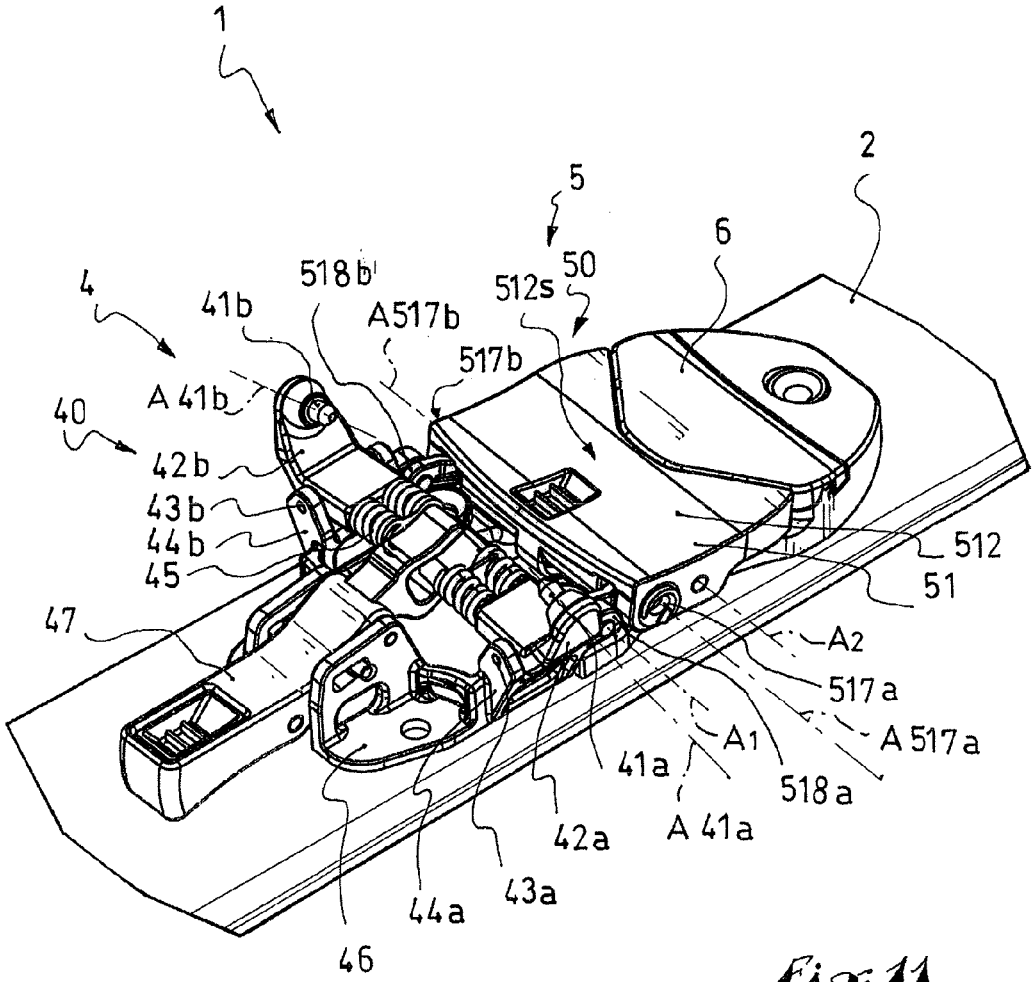
FIGS. 11 and 12 are perspective views of the front retaining devices of a gliding apparatus according to a second embodiment.
Figure 12:
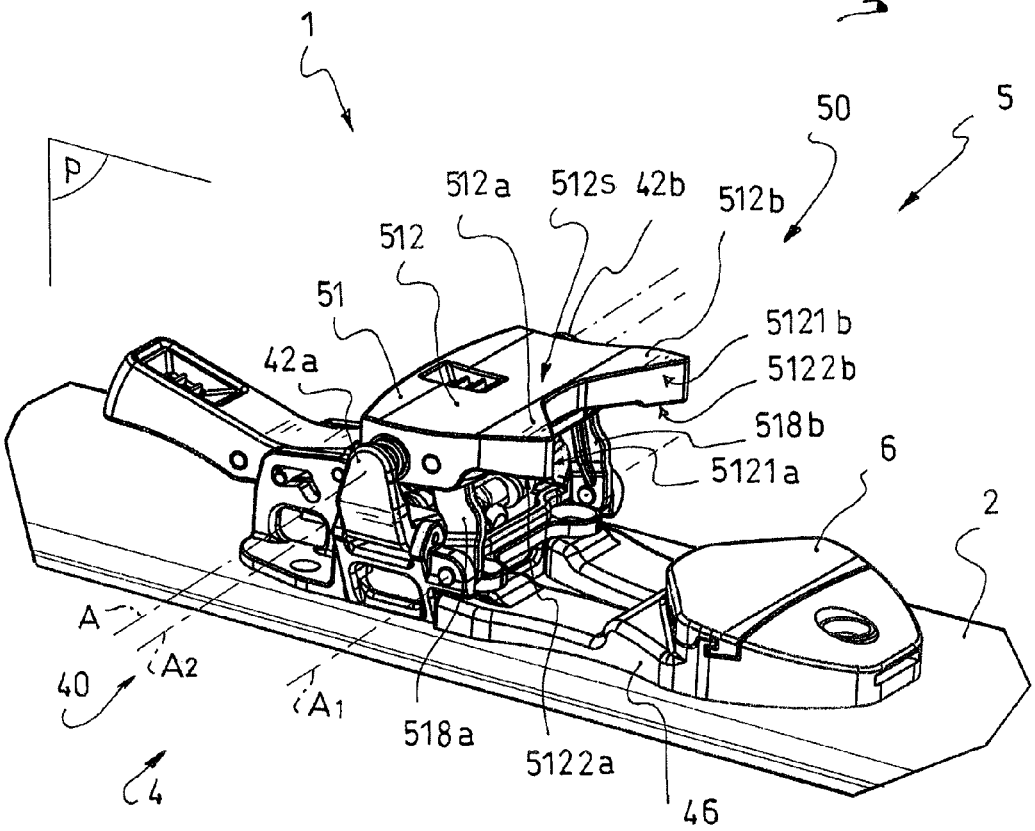

The invention is illustrated in the context of a gliding apparatus 1 comprising a gliding board 2 supporting a binding comprising a front retaining device 4 for retaining a boot 3, designed for the ascent phase during ski touring, a front retaining device 5 designed for the descent, and a rear retaining device, not shown. FIGS. 1-9 illustrate certain constructional details of the invention, in particular the arrangement and kinematics envisioned for the two front retaining devices of the invention, one device being designed for slope ascent and the other for slope descent. FIG. 10 shows a construction similar to that illustrated in FIGS. 1-7, but incorporating the details for maintaining the second retaining device in its active configuration. FIGS. 11 and 12 show a second embodiment of the invention.

The following description uses terms such as "horizontal", "vertical", "longitudinal", "transverse", "upper", "lower", "top", "bottom", "front", and "rear". These terms should be understood as relative with respect to the normal position of the retaining device on a ski, and the normal ski forward moving direction. The front retaining device is also called the "toe-piece." The rear retaining device is also called the "heel-piece."

The touring ski boot 3, adapted for the gliding apparatus 1, includes a sole 32, arranged under the foot, and an upper portion 33, called the upper, covering the remainder of the foot. The sole 32, or outer sole, comprises a lower surface 323 adapted to be in contact with the ground or an element of the upper surface of the gliding board. In its front portion, the sole extends slightly forward in relation to the upper 33, thereby forming a front end. This front end includes a front surface 321 and an upper surface 322. The front surface 321 covers the front of the end of the sole and extends partially over the front portion of the lateral vertical surfaces of the sole 32. The upper 33 also comprises a front surface 331. It covers the front of the upper and extends partially over the front portion of the lateral vertical surfaces of the upper. This front surface 331 is arranged directly above the upper surface 322 of the front end of the sole 32. The illustrated touring ski boot further includes two lateral housings 31*a*, 31*b* arranged on respective sides of the front portion of the sole 32 of the boot 3 and aligned along an axis transverse to the longitudinal axis of the sole. These housings are cylindrical and adapted to receive members 41*a*, 41*b* for fastening the ascent toe-piece.

Figure 1:
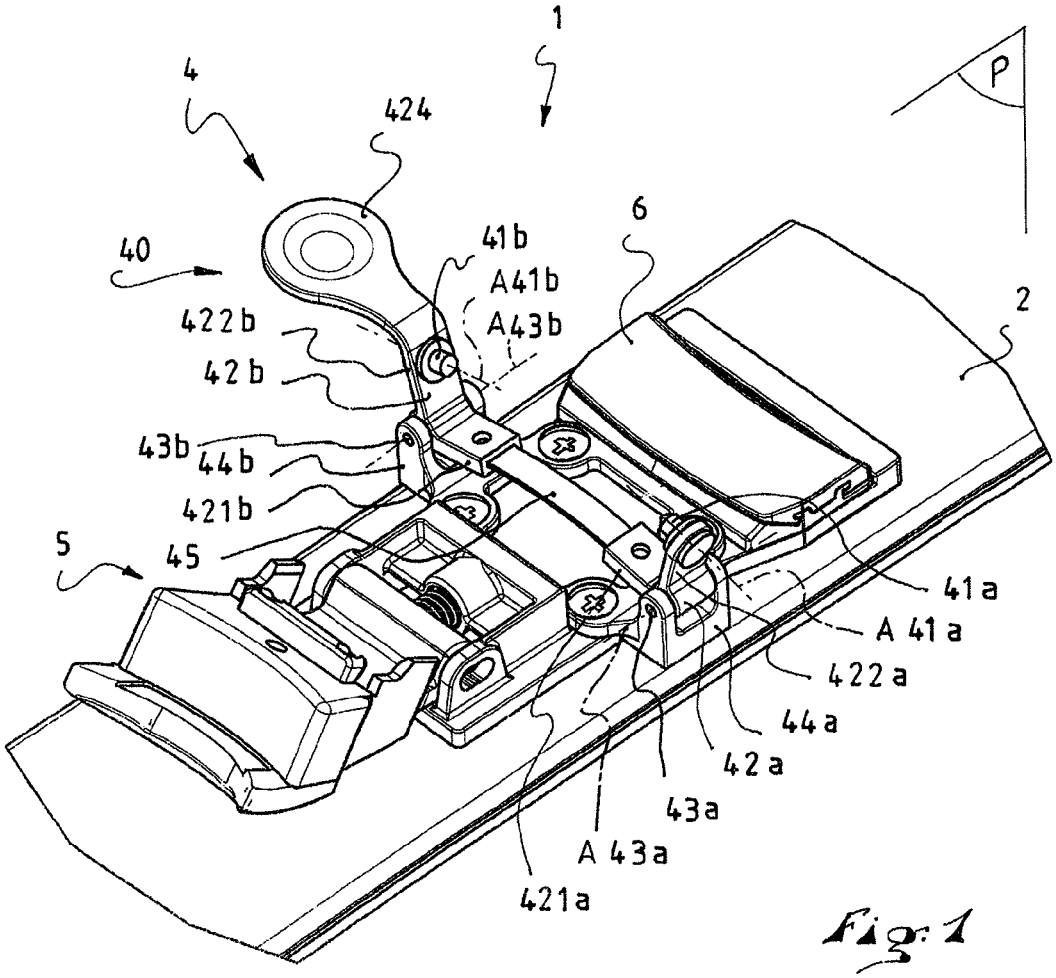
FIG. 1 is a perspective view of the front retaining devices of a gliding apparatus illustrating constructional details of the invention.
Figure 2:
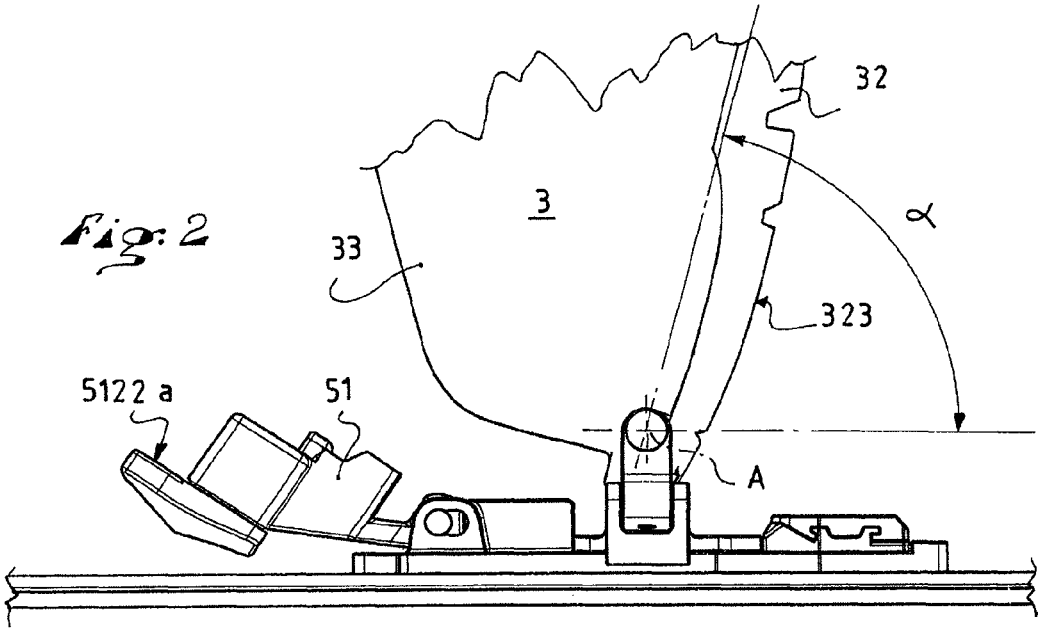
FIG. 2 is a side view of the gliding apparatus of FIG. 1, equipped with a boot in engagement with the first front retaining device provided for the ascent.

According to the embodiment illustrated in FIGS. 1-7, the first front retaining device 4, provided for the ascent, includes two fastening members 41*a*, 41*b*, having respective axes A41*a*, A41*b* capable of cooperating with two lateral housings 31*a*, 31*b* of the boot 3, having respective axes A31*a*, A31*b*, and arranged on respective sides of the front portion of the sole 32 of the boot 3. This cooperation corresponds to the engagement of the ascent toe-piece 4. The axes A31*a*, A31*b*, A41*a*, A41*b* are substantially aligned along an articulation axis A transverse to the longitudinal axis of the gliding apparatus, when the ascent toe-piece 4 is engaged. The boot 3 can then pivot about this articulation axis A, i.e., the heel of the boot can alternately be raised and lowered in relation to the gliding board 2. For example, FIG. 2 illustrates the ascent toe-piece 4 engaged with the boot 3 and after the boot has been pivoted about the axis A. When the ascent toe-piece 4 is released, the axes A41*a*, A41*b* are not necessarily aligned.

To provide the cooperation between the fastening members 41*a*, 41*b* and the lateral housings 31*a*, 31*b*, the fastening members are movable transversely in relation to the ski so as to bring them closer together or to space them apart. When they are brought adequately close to one another, the fastening members can cooperate with the lateral housings. The ascent toe-piece is then engaged. When they are moved farther apart, the fastening members no longer cooperate with the lateral housings. The boot is released. The ascent toe-piece is then released. To maintain the fastening members closer together or spaced apart, the ascent toe-piece 4 includes an elastic mechanism 45 exerting a force on the fastening members 41*a*, 41*b* that moves them closer together or farther apart.

In this example, the fastening members 41*a*, 41*b* are cylindrical pins having respective axes A41*a*, A41*b*. Fastening members of other shapes are also within the scope of the invention, such as cones, points, domes, etc. Each alternative fastening member assumes a revolution shape. Each pin 41*a*, 41*b* is mounted on an angle bracket 42*a*, 42*b*, respectively. Each angle bracket 42*a*, 42*b* is arranged in the area of a lateral side of the gliding board. An arm 421*a*, 421*b* of the "L" of the angle bracket extends substantially toward the median portion of the board while the other arm 422*a*, 422*b* of the "L" of the angle bracket extends substantially upward, in a direction away from the board. Thus, the two angle brackets 42*a*, 42*b l* are arranged symmetrically in relation to the median plane P of the board. They are opposite one another. Each pin 41*a*, 41*b* is fixed to the inner surface of the arm 422*a*, 422*b*, that is to say, the surface turned toward the median portion of the board. Each pin is also located close to the free end of the arm 422*a*, 422*b*. Each pin 41*a*, 41b extends toward the median portion of the board. Each angle bracket 42*a*, 42*b* also includes a bore extending through the width of the angle bracket, in the area of the junction between its arms 421*a*/422*a*, 421*a*/422*b*. Each bore 423*a*, 423*b* is adapted for receiving a shaft 43*a*, 43*b*, having an axis A43*a*, A43*b*, mounted on a clevis 44*a*, 44*b*. The clevis 44*a*, 44*b* is arranged so that the axes A43*a*, A43*b* are substantially parallel to the longitudinal axis of the ski. Accordingly, each angle bracket 42*a*, 42*b* can pivot about the longitudinal axis A43*a*, A43*b*. These rotations make it possible to move the pins 41*a*, 41*b* closer to or away from one another.

Because the fastening members 41*a*, 41*b* are only movable in the same plane, transverse to the board, this construction makes the ascent toe-piece more compact longitudinally.

To maintain the angle brackets 42*a*, 42*b* in predetermined stable angular positions, the arms 421*a*, 421*b* are connected by the elastic mechanism 45. Two stable angular positions are desired, namely, an engagement position for which the pins 41*a*, 41*b* are adapted to cooperate with the lateral housings 31*a*, 31*b* of the boot, and a rest position for which the pins are sufficiently spaced apart to release the boot 3. In this embodiment, the elastic mechanism is a flexible metal blade, each end of which is inserted in the arms 421*a*, 421*b*, respectively, of the angle bracket 42*a*, 42*b*.

Figure 3:
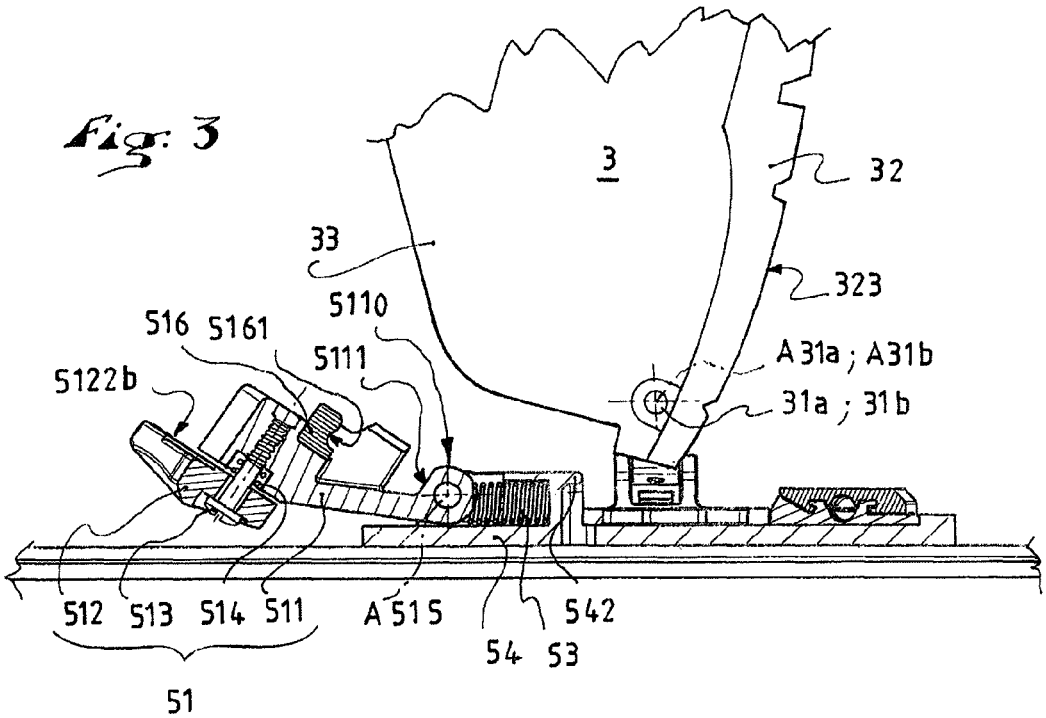
FIG. 3 is a cross-sectional view, along the longitudinal median plane, of the fitted gliding apparatus of FIG. 2.
Figure 4:
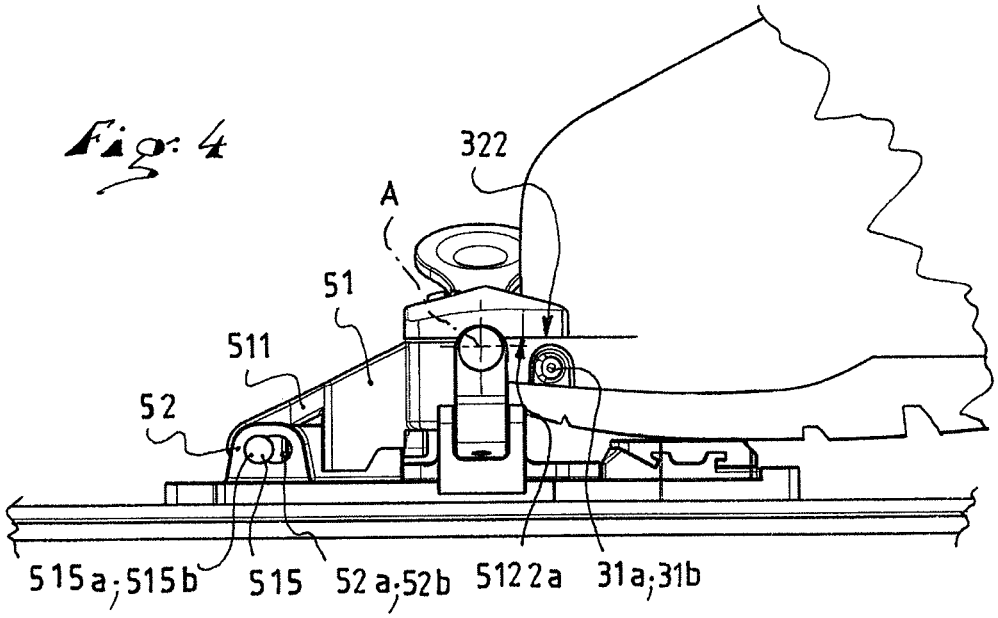
FIG. 4 is a side view of the gliding apparatus of FIG. 1, equipped with a boot in engagement with the second front retaining device provided for the descent.
Figure 5:
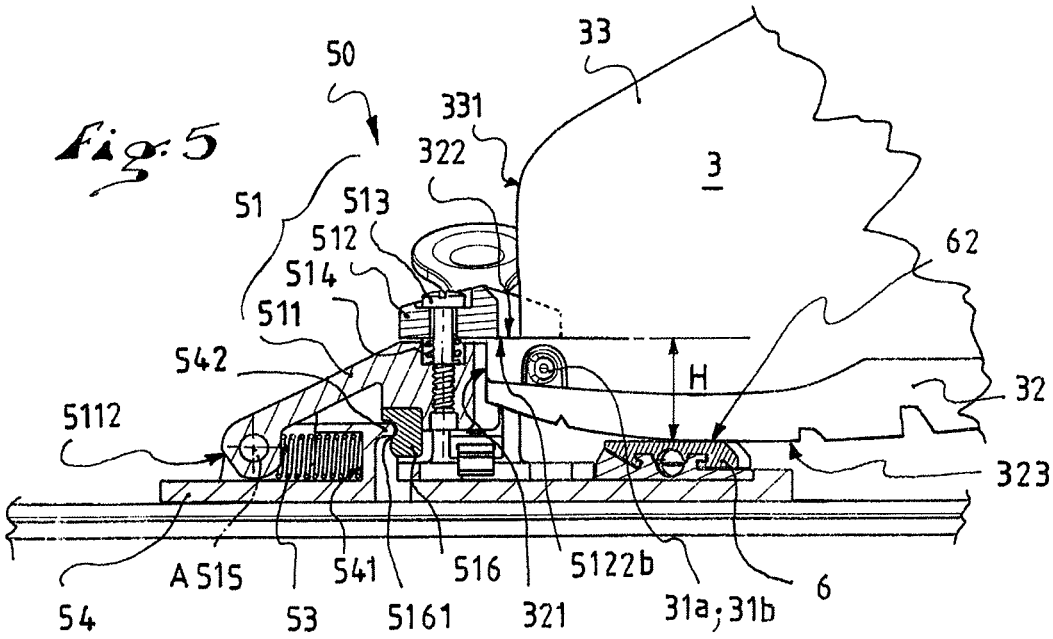
FIG. 5 is a cross-sectional view, along the longitudinal median plane, of the fitted gliding apparatus of FIG. 4.
Figure 6:
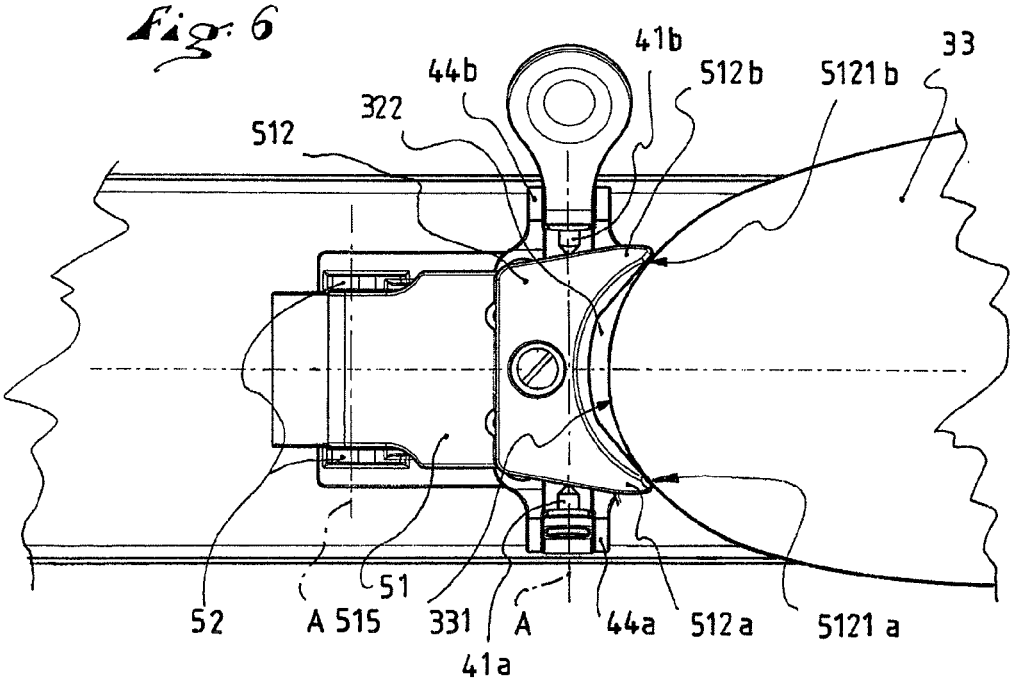
FIG. 6 is a top view of the fitted gliding apparatus of FIG. 3.

These bi-stable positions are obtained due to the metal blade whose length at rest is greater than the distance separating the two opposing arms 421*a*, 421*b* when the angle brackets 42*a*, 42*b* are assembled in their respective clevis 44*a*, 44*b*. Thus, the metal blade systematically seeks a stable position in which the length of the blade is its length at rest. Due to the angle brackets coming closer together, the ascent toe-piece provides two stable positions corresponding to two flexes of the metal blade. In the first stable position, the blade is curved upward or outward of the board in relation to a plane passing through the two pivot axes A43*a*, A43*b* of the angle brackets. In this configuration, the ascent toe-piece is disengaged. The boot is released. This configuration is shown in FIGS. 1, 4 and 5. In the second stable position, the blade is curved downward or toward the board, in relation to a plane passing through the two pivot axes A43*a*, A43*b* of the angle brackets. In this configuration, the ascent toe-piece is engaged. The boot is engaged with the fastening members. This configuration is shown in FIGS. 2 and 3.

The stiffness and length of the blade at rest determines the amount of retaining force of the fastening members on the boot, as well as the handling force required to actuate or disengage the ascent toe-piece.

In an alternative embodiment, other elastic mechanisms 45 can be used. For example, the blade connecting the angle brackets can be made of carbon, fiberglass. The elastic mechanism may be a coil spring. Alternatively, the two angle brackets 42*a* and 42*b* can be connected to one another to form a single piece, i.e., a single piece of material. The junction between the two angle brackets is then dimensioned to permit flexing and sufficient energy to obtain the two stable positions described above.

The first mechanism 40 for fastening the boot 3 therefore includes the pins 41*a*, 41*b*, the angle brackets 42*a*, 42*b*, the shafts 43*a*, 43*b*, the devises 44*a*, 44*b*, and the metal blade 45.

Alternatively, a latch could complete the first mechanism for securing the retention in a stable configuration, for example the ascent configuration in which the pins should not be spaced apart.

To manipulate this first mechanism 40, a lever shaped like a circular plate 424 is fixed to the "free" end of the arm 422*b* of one of the two angle brackets 426*b*. This plate 424, or manipulatable member, extends the "free" end of the angle bracket and extends transversely outward of the board. The plate is oriented to be parallel to the surface of the ski sole. The plate 424 is slightly curved downward and thus forms a recess on its upper surface for receiving the tip of a ski pole. As a result, the skier, pressing on the plate with the ski pole, causes the rotation of one angle bracket 42*b*, in one direction, but also the rotation of the other angle bracket 42*a* in the opposite direction, due to the metal blade 45 connecting the two angle brackets. This action causes the spacing apart of the pins 41*a*, 41*b*, and therefore the release of the boot 3. Other forms for the lever 424, providing the same effects, are within the scope of the invention.

To engage the ascent toe-piece, it suffices to position the front of the boot on the angle brackets. By lowering the front of the sole, one presses directly on the arms 421*a*, 421*b* and on the elastic blade 45, which causes the rotation of the angle brackets 42*a*, 42*b* in opposite directions, thereby bringing the pins 41*a*, 41*b* closer together, which then engage in the lateral housings 31*a*, 31*b* of the sole. The boot is then engaged with the ascent toe-piece.

The invention is also applicable to other embodiments of the ascent toe-piece. The front retaining device must comprise a first mechanism for fastening the boot defining an articulation axis about which the boot pivots during the ascent. Examples of applicable ascent toe-pieces are shown in the documents EP-A-0 199 098 and FR-A-2 945 185. In an alternative embodiment, the fastening members can be on the boot and the complementary housings in the area of the ascent toe-piece.

With respect to the descent, the binding of the boot is comprised of a second front retaining device 5, provided for the descent, and a rear retaining device, not shown. Only the toe-piece 5 will be described in detail. As shown, both the ascent toe-piece 4 and the descent toe-piece are supported by the same, i.e., a common, plate 54, the latter being mounted on the gliding board 2.

In order for the boot to be properly retained during the descent, the boot is generally sandwiched longitudinally between the toe-piece and the heel-piece. In the vertical direction, the sole is also immobilized at the front and at the rear. At the front, the sole is generally sandwiched between a support plate arranged on the board and a lower surface of the jaws of the toe-piece. At the rear, the sole is generally sandwiched between the support plate of the brake and a lower surface of the jaws of the heel-piece.

For the longitudinal and transverse immobilization, there are mainly two alternatives for retaining the boot in the area of the toe-piece, i.e., either an upper engagement, or a sole engagement. The upper engagement means that the jaw of the descent toe-piece comes into contact with the front surface 331 of the upper 33 of the boot. The jaw generally forms a "V", each wing of which presses on a portion of the front surface 331. The boot is thus blocked longitudinally and transversely in the area of the toe-piece. The sole engagement is similar to the upper engagement, except that the wings of the jaw of the descent toe-piece press on the front surface 321 of the sole 32 of the boot. The contact between the descent toe-piece and the boot is lower.

According to the embodiment illustrated in FIGS. 1-5, the descent toe-piece 5 uses the operating principle of the upper engagement. The invention could also be applied to a descent toe-piece functioning with a sole engagement.

The descent toe-piece 5 includes a movable element 51 comprising a body 511 to which is attached a V-shaped sole-clamp 512, the wings 512*a*, 512*b* of which extend symmetrically in relation to the median plane P of the gliding board. When the movable element is positioned so as to be in contact with the boot, the wings 512*a*, 512*b* extend in a rearward direction of the board. In this configuration, the free end of a wing 512*a*, 512*b* includes a vertical surface 5121*a*, 5121*b* facing rearward, and a lower surface 5122*a*, 5122*b*, or horizontal surface facing downward, i.e., toward the gliding board. The vertical surface 5121*a*, 5121*b* is then in contact with the front surface 331 of the upper 33. The lower surface 5122*a*, 5122*b* is then in contact with the upper surface 322 of the front edge of the sole 32 of the boot. The vertical surfaces 5121*a*, 5121*b* and lower surfaces 5122*a*, 5122*b* thus form an interface surface adapted to come into contact with a front portion of the boot.

As mentioned above, the vertical surfaces 5121*a*, 5121*b* provide the longitudinal and lateral stop of the front of the boot. The sole is sandwiched in order to vertically affix the front of the boot 3 to the board 2. The lower surface 323 of the sole 32 is in contact with the upper surface 62 of a support plate 6 fixed to the board 2, on the one hand, and the upper surface 322 of the front edge of the sole 32 is in contact with the lower surfaces 5122*a*, 5122*b* of the wings of the sole-clamp 512, on the other hand. A sole height H is defined as the distance separating the plane including the upper surface 322 and a parallel plane passing through the lower surface 323, in the area of the zone of contact with the support plate 6.

The second mechanism 50 for fastening the boot 3 therefore includes the movable element 51 incorporating the sole-clamp 512, the support plate 6, and the heel-piece.

According to one embodiment, the descent toe-piece incorporates a device for adjusting the position of the sole-clamp in order to be compatible with various sole heights H. As shown in FIG. 5, the sole-clamp 512 is connected to the body 511 via a screw 513, which is vertically screwed onto the body and extends through the sole-clamp. A spring 514 makes it possible to push the sole-clamp 512 against the head of the screw 513. Thus, by modifying the screw engagement height, the vertical position of the lower surfaces 5122*a*, 5122*b* is modified.

The second front retaining device 5 is specific in that it can be set in a first configuration, a so-called inactive configuration, and in a second configuration, a so-called active configuration. Thus, depending upon the configuration of this descent toe-piece 5, the gliding apparatus 1 is configured either for the descent, or for the ascent. If the descent toe-piece is in its inactive configuration, the front of the boot is retained by the ascent toe-piece 4. If the descent toe-piece is in its active configuration, the front of the boot is retained by the descent toe-piece 5. The descent toe-piece 5 is activated when the interface surface 5121*a*, 5121*b*, 5122*a*, 5122*b* is in contact with the front portion of the boot as described above. To modify the configuration and deactivate the descent toe-piece 5, it suffices to move the interface surface away from the front portion of the boot, as shown in FIGS. 2 and 3, whereby the interface surfaces 5122*a*, 5122*b* face away from gliding board. To this end, the element 51 incorporating the interface surface is movable.

According to an embodiment shown in FIGS. 1-5, a shaft 515, having an axis A515, is tightly mounted on the body 511 of the movable element 51. The shaft 515 is assembled in a clevis 52 (see FIG. 4) including oblong holes 52*a*, 52*b* for receiving each end 515*a*, 515*b* of the shaft 515. The clevis 52 is positioned at the front of the board in relation to the ascent toe-piece 4. The clevis 52 is arranged so that the oblong holes 52*a*, 52*b* are aligned along a direction transverse to the board and are oriented along a direction parallel to the longitudinal axis of the board. A spring 53 is compressed between a portion of the body 511 located in the vicinity of the shaft 515 and a vertical surface 541 of a plate 54 fixed to the plate to which the clevis 52 is affixed. The spring 53 extends longitudinally along the median axis of the board. The spring 53 acts on the body so as to continuously press the shaft 515 of the body 511 against the front ends of the oblong holes 52*a*, 52*b*. This construction enables the rotation of the movable element 51 about the axis A515 when it is pressed against the front ends of the oblong holes 52*a*, 52*b*, that is to say, about an axis transverse to the board.

The clevis 52 and the movable element 51 are sized and arranged so that the movable element can take up any of a plurality of positions, as described below.

A first position of the movable element 51 corresponds to the active configuration of the second retaining device 5, for which the interface surface is in contact with the front portion of the boot. The movable element 51 is tilted rearward, so that the interface surface is positioned rearward, in relation to the pivot axis. In this arrangement, the interface surface is slightly set back rearward with respect to the axis of rotation A. This facilitates the possible lateral release of the front of the boot. In this configuration, a portion of the body 511 is housed between the arms 422*a*, 422*b* of the angle brackets 42*a*, 42*b*. For this, this portion of the body 511 has a width less than the distance between the ends of the pins 41*a*, 41*b*, in the inactive configuration of the ascent toe-piece 4. Thus, this makes the front retaining devices more compact. There is a lower risk of catching the first retaining device. The fastening members 41*a*, 41*b* are less accessible, and therefore less likely to cause injuries. This first position of the movable element 51 (corresponding to the active configuration of the descent toe-piece 5) is shown in FIGS. 4-7.

The movable element 51 can take a second position corresponding to the inactive configuration of the second retaining device 5. In this case, the movable element is fully tilted forward, so that the interface surface is positioned forward in relation to the pivot axis. Thus, the surface is away from the front portion of the boot and is positioned longitudinally forward of the gliding apparatus, in relation to the articulation axis A. The first retaining device 4 is then operational. In this configuration, the movable element 51 is sized so that no constituent portion of the movable element interferes with the rotation of the boot about the articulation axis A, by an angle $\alpha$of at least 70°, from a position of the boot supported on the board, when the boot is retained by the first front retaining device 4. In other words, the front of the boot upper does not abut against any component of the movable element 51 when the boot rotates toward the front of the board, by an angle $\alpha$of at least 70°, about the articulation axis A. This second position is illustrated through FIGS. 2 and 3.

To switch from the first position to the second position, the movable element includes a partially cylindrical outer surface 5110, having an axis A515, against which the spring 53 presses. This surface 5110 includes two flat portions 5111, 5112 defining two stable positions corresponding to the first and second positions, respectively, of the movable element. Indeed, in these two specific positions, the support one end of the spring 53 on one of the flat portions 5111, 5112 is more pronounced than for the other intermediate positions, which enables the movable element 51 to be indexed.

According to one embodiment, a latch 516 is attached to the body 511 in order to securely maintain the movable element 51 in its first position. This latch includes a housing 5161 adapted to cooperate with a projection 542 of the plate 54, or mounting plate, when the movable element is in its first position. In this example, the projection and the housing are oriented along the longitudinal direction of the board. This cooperation prevents the rotation of the movable element 51 and makes it possible to resume the forward longitudinal forces transmitted by the boot to the board, via the descent toe-piece. To lock/unlock the movable element, it is necessary to slightly space the movable element apart toward the rear, at the end of the rearward rotation, in order for the projection 542 to settle in the housing 5161. This is why the ends 515*a*, 515*b* of the shaft 515 are housed in the oblong holes 52*a*, 52*b* oriented along a longitudinal direction. As a result, the user can move the movable element rearward, by compressing the spring 53 to activate the lock as described above.

According to one embodiment, the latch 516 is made of a material and is designed for facilitating the activation of the lock and/or to compensate for the variations in sole height H inherent in the manufacturing tolerance of the boot 3.

This mechanism for securely maintaining the movable element 51 in its first position incorporating the latch 516 is optional in the case in which the first fastening mechanism 40 is provided to be capable of cooperating with the movable element 51 so as to maintain the second retaining device 5 in its active configuration. It could still be kept in order to improve the robustness, or strength, of the binding in the case in which the first fastening mechanism is defective. The latch would then make it possible to maintain the second front retaining device 5 in its active configuration.

It should be noted that the first and second front retaining devices are continually affixed to the gliding board 2. That is, they are concurrently affixed to the board while the board is being used, i.e., when the skier skis; neither device must be removed to accommodate the mounting of the other to the gliding board. This construction makes it possible to eliminate the risk of losing an element of the binding. The skier is guaranteed to always have a suitable binding for each phase of ski touring practiced, whether in the ascent or in the descent.

During the descent phase, the binding must enable the vertical and lateral release of the boot in the event of a fall in order not to injure the skier. In conventional bindings for the descent, the vertical release is provided by the heel-piece, whereas the lateral release is provided by the toe-piece.

According to one embodiment, the descent toe-piece of the gliding apparatus according to the invention does not incorporate a mechanism for lateral release of the front portion of the boot. This makes it possible to obtain a much simpler and, therefore, lighter descent toe-piece. To ensure a lateral release, the gliding apparatus may comprise a double-release heel-piece, including a lateral release and a vertical release.

Figure 7:
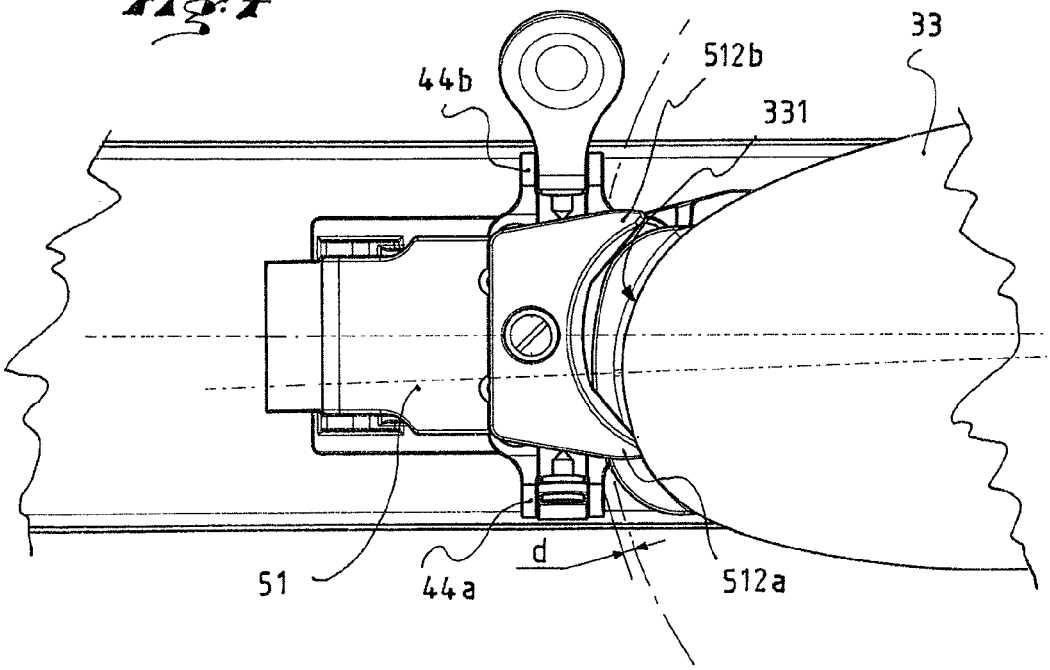
FIG. 7 is a top view of the fitted gliding apparatus of FIG. 3, the boot being shown in a lateral release position.

A form of lateral release, among others, may be a simple backward movement of the heel-piece, thereby causing the relative spacing between the toe-piece and the heel-piece. This displacement releases the boot which is no longer engaged with the two front and rear retaining devices. The rear of the boot can pivot about a vertical axis substantially at the front of the boot, or the front of the boot can pivot about a vertical axis substantially at the rear of the boot. In the latter case, the rotation of the boot should not be hindered. Thus, when the second device is in its active configuration, the interface surface is positioned longitudinally with respect to the first front retaining device, so that no element of the first front retaining device interferes with a lateral release of the front portion of the boot. In embodiment being described, the arms 422*a*, 422*b* of the angle brackets 42*a*, 42*b* are setback forward in relation to the front of the boot during lateral release. The front of the boot can pivot freely about a vertical axis substantially at the rear of the boot, as shown in FIG. 7. Thus, during release, the front of the boot remains away from the clevis 44*a* by a distance "d". The first front retaining device therefore does not interfere with the lateral release movement.

In an alternative embodiment, the descent toe-piece includes a lateral release mechanism.

The embodiment of FIGS. 1-7 shows a second front retaining device 5 configurable by rotation of the movable element 51 about a transverse axis. Alternatively, the invention extends to other types of movement of the movable element.

For example, the element 51 may be movable in translation, in rotation along another axis, or a combination of translational and rotational movements.

Figure 8:
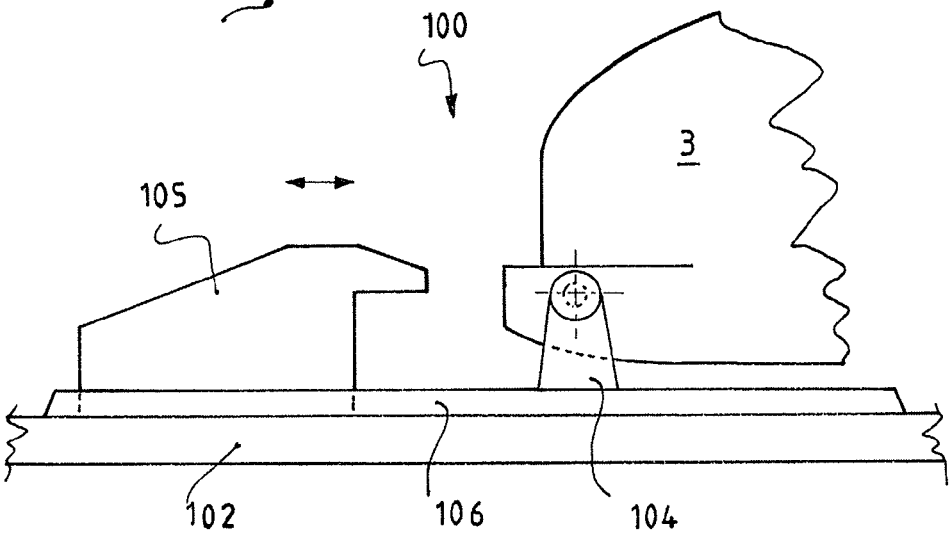
FIG. 8 is a schematic view of a gliding apparatus according to another method for arranging the front retaining devices, configured in the ascent position.
Figure 9:
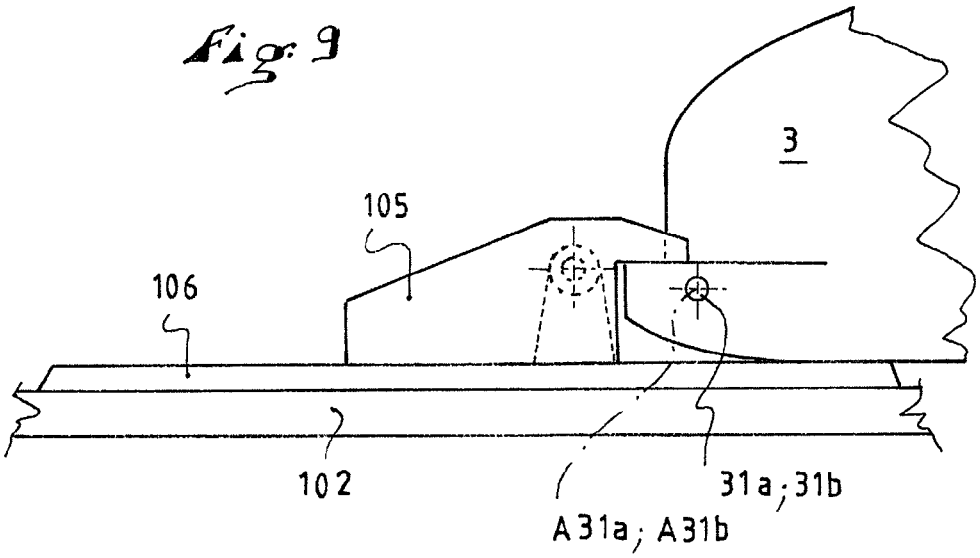
FIG. 9 is a schematic view of the gliding apparatus of FIG. 8, configured in the descent position.

FIGS. 8 and 9 schematically show a gliding apparatus 100 according to the invention, the descent toe-piece 105 of which is mounted on a longitudinal rail 106 fixed to the board 102. Thus, the descent toe-piece 105 can slide along a direction parallel to the longitudinal axis of the board in order to switch from an active configuration to an inactive configuration, or vice versa. The gliding apparatus 100 also includes an ascent toe-piece 104 similar to that described above.

All of the constructions described above enable a sufficient rotation of the boot, during the ascent phase, to improve the ease of movement and, more particularly, for the inclined slopes. This freedom of movement is all the more necessary as the (rear) foot is moved back during a walking motion.

In the previous examples, the kinematics of the movable element makes it possible to space a portion of the second fastening mechanism apart toward the front of the ski, in relation to the first mechanism. Thus, the first front retaining device can be designed to position the boot as close to the ski sole as possible. This configuration is desired to increase stability by improving the skier's supports.

To further secure the binding, the movable element is separate from the first fastening mechanism. Thus, if the first fastening mechanism is damaged, then the second fastening mechanism remains operational, and vice versa. In addition, the gliding apparatus is more easily repairable if an element is damaged, due to the relative independence of one mechanism in relation to the other or, at least, of the interface elements with the boot. The apparatus is therefore more reliable.

FIG. 10 illustrates an alternative embodiment of a gliding apparatus whose first mechanism 40 for fastening the boot is capable of cooperating with the movable element 51 of the second front retaining device 5 so as to maintain the second front retaining device 5 in its active configuration.

This construction makes it possible to simplify the gliding apparatus, and to make it lighter and compact. In this example, the body 511 comprises two lateral housings 517*a*, 517*b*, having axes A517*a*, A517*b*, and arranged on respective sides of the body 511, in a manner similar to the lateral housings 31*a*, 31*b* of the boot 3. These lateral housings of the body are arranged so as to be capable of cooperating with the two fastening members 41*a*, 41*b* of the first front retaining device 4 when the second front retaining device 5 is in its active configuration. During this cooperation, the axes A517*a*, A517*b*, A41*a*, A41*b* are substantially aligned along an axis transverse to the longitudinal axis of the gliding apparatus. As a result, the two fastening members 41*a*, 41*b* ensure that the second front retaining device 5 is securely maintained in its active configuration when they cooperate with the lateral housings of the body. In this case, the movable body 51 can no longer rotate about the axis A515.

To modify the configuration of the second front retaining device, it is then necessary to deactivate the first front retaining device.

According to one embodiment, the forces retaining the boot, especially the longitudinal retaining forces, are not transmitted in the area of the fastening members but by the cooperation of other members of the toe-piece with a support fixed to the ski. This may be analogous to the cooperation between the latch 516 and the projection 542 of the plate 54. Thus, the fastening members are only slightly biased during the descent phase.

FIGS. 11 and 12 show a second embodiment of a gliding apparatus according to the invention. FIG. 11 illustrates the gliding apparatus at rest, the first fastening mechanism being in a configuration enabling the release of the boot. FIG. 12 illustrates the gliding apparatus in a descent configuration, the second front retaining device 5 being held by the first fastening mechanism 40.

In describing this second embodiment, the elements similar to those of the first embodiment are designated by the same reference numerals.

In this example, the first front retaining device 4 has a similar design to that described in the document EP-A-0 199 098. It comprises a base 46 supporting a first fastening mechanism 40 including two pins 41*a*, 41*b*, having axes A41*a*, A41*b*. Each pin 41*a*, 41*b* is mounted on an angle bracket 42*a*, 42*b*. Each angle bracket 42*a*, 42*b* pivots about a shaft 43*a*, 43*b* supported by a clevis 44*a*, 44*b*. The median arm of one angle bracket is connected to the median arm of the other angle bracket by an elastic mechanism 45, in this case springs. This elastic connection provides two stable positions for the first fastening mechanism 40, namely an engagement position for which the pins 41*a*, 41*b* are adapted to cooperate with the lateral housings 31*a*, 31*b* of the boot 3, and a rest position for which the pins are sufficiently spaced apart to release the boot. To actuate the first fastening mechanism 40, the user acts on one end of a lever 47 so as to cause a displacement of the other end forming a fork in engagement with the middle of the elastic connection. The induced vertical displacement of the middle of the elastic connection ensures the switch from one stable configuration to the other stable configuration.

For this embodiment, the first mechanism 40 for fastening the boot 3 therefore includes the pins 41*a*, 41*b*, the angle brackets 42*a*, 42*b*, the shafts 43*a*, 43*b*, the devises 44*a*, 44*b*, the elastic mechanism 45, and the lever 47.

As in the first embodiment, the gliding apparatus 1 also includes a support plate 6 arranged at the rear of the ski in relation to the first front retaining device 4. In this example, the support plate 6 is supported by the base 46.

In this second embodiment the second front retaining device 5 becomes housed beneath the front of the boot, between the first front retaining device 4 and the support plate 6, when it is in the first, so-called inactive configuration.

Similar to the second front retaining device 5 of the first embodiment, the one here includes a movable element 51 comprising a V-shaped sole-clamp 512, the wings 512*a*, 512*b* of which extend symmetrically in relation to the median plane P the gliding board. When the movable element is positioned so as to be in contact with the boot, the wings 512*a*, 512*b* extend rearward of the gliding board. In this configuration, the free end of a wing 512*a*, 512*b* includes a vertical surface 5121*a*, 5121*b* oriented rearward of the board, and a lower surface 5122*a*, 5122*b* oriented toward the gliding board. The vertical surface 5121*a*, 5121*b* is then in contact with the front surface 331 of the upper 33. The lower surface 5122*a*, 5122*b* is then in contact with the upper surface 322 of the front edge of the sole 32. The vertical surfaces 5121*a*, 5121*b* and the lower surfaces 5122*a*, 5122*b* thus form an interface surface adapted to come into contact with a front portion of the boot.

This construction is particular in that the sole-clamp 512 is connected to the base 46 by two lateral arms 518*a*, 518*b*. Each lateral arm 518*a*, 518*b* includes a first end rotatably mounted in the area of the base 46 about a first axis A1 transverse to the longitudinal axis of the gliding apparatus, and a second end rotatably mounted in the area of the sole-clamp 512 about a second axis A2 transverse to the longitudinal axis of the gliding apparatus. Thus, the first transverse axis A1 enables the sole-clamp 512 to be folded rearward of the gliding board in order to retract the second front retaining device 5. The second transverse axis A2 enables the sole-clamp 512 to pivot so that its upper surface 512*s* is substantially parallel to the upper surface of the gliding board, thereby making the binding more compact when configured for the ascent.

The second mechanism 50 for fastening the boot 3 therefore includes the movable element 51 incorporating the sole-clamp 512, the support plate 6, and the heel-piece.

In this example, the base 46 includes a housing for the sole-clamp 512, arranged between the first front retaining device 4 and the support plate 6, and dimensioned so that the upper surface 512*s* of the sole-clamp 512 is substantially at the same height as or setback in relation to the upper surface of the support plate 6 when the second front retaining device 5 is folded in its first, so-called inactive, configuration.

In this embodiment, the second front retaining device 5 is maintained in its active configuration in the same fashion as in the first embodiment. The sole-clamp 512 includes two lateral housings 517*a*, 517*b*, having axes A517*a*, A517*b* and arranged on both sides of the sole-clamp 512. As seen above, the lateral housings of the body are arranged so as to be capable of cooperating with the two fastening members 41*a*, 41*b* of the first front retaining device 4 when the second front retaining device 5 is in its active configuration. During this cooperation, the axes A517*a*, A517*b*, A41*a*, A41*b* are substantially aligned along an axis transverse to the longitudinal axis of the gliding apparatus. As a result, the two fastening members 41*a*, 41*b* ensure that the second front retaining device 5 is securely maintained in its active configuration when they cooperate with the lateral housings of the body. To modify the configuration of the second front retaining device, it is then necessary to deactivate the first front retaining device.

This second embodiment makes it possible to use a first front retaining device 4 having a design similar to that of the currently commercially available devices. These known devices have a functional ergonomics that is well understood by the public. In addition, this construction is compact and well integrated, reinforcing the robustness/strength of the binding. This construction only slightly extends forward of the gliding board, thereby limiting the risk of catching external bodies. However, compared to the first embodiment, this construction slightly raises the position of the boot during the ascent phase, which somewhat penalizes the skier's performance.

In the preceding embodiments, the retaining structure 517*a*, 517*b* and fastening members 41*a*, 41*b* are sized so that the first fastening mechanism 40 releases the movable element 51, when the first fastening mechanism 40 is deactivated, so as to release the boot. This makes it possible to simplify the ergonomics of use.

As seen from the two embodiments shown in FIGS. 10 to 12, the second front retaining device 5 is maintained in its active configuration by the cooperation between two lateral housings 517*a*, 517*b* and the two fastening members 41*a*, 41*b* of the first front retaining device 4. Alternatively, one can consider using other retaining members, instead of the two fastening members 41*a*, 41*b* of the first front retaining device 4. For example, it may be other points fixed to one of the arms of the angle brackets 42*a*, 42*b*, respectively, of the first front retaining device 4. These points cooperate with the lateral housings 517*a*, 517*b* correctly arranged on the movable element 51 to ensure that the movable element is immobilized when the second front retaining device 5 is in an active configuration. In this case, the movement of these retaining members is related to the movement of the angle brackets 42*a*, 42*b*, as in the first embodiment. This alternative embodiment makes it possible to provide a different anchoring which, for example, can be more robust or easier to actuate (less actuation force).

The invention is not limited to the embodiments described above and covers all possible combinations.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A gliding apparatus including:

a gliding board;

a front binding comprising:

a first front retaining device for retaining a boot provided for ascending a slope, the first front retaining device comprising a first boot-fastening mechanism, the mechanism defining an articulation axis about which the boot pivots during use of the binding while ascending a slope;

a second front retaining device for retaining the boot provided for descending a slope with the boot not pivoting about the articulation axis, the second front retaining device comprising a second boot-fastening mechanism, the second mechanism including a movable element incorporating an interface surface designed to come into contact with a front portion of the boot, the movable element being separate from the first boot-fastening mechanism, the second front retaining device being selectively configurable into either of the following:

an inactive configuration, for which the interface surface is out of contact with the front-portion of the boot; and an active configuration, for which the interface surface is in contact with the front portion of the boot;

the first boot-fastening mechanism being configured to operatively engage the movable element of the second front retaining device so as to maintain the second front retaining device in the active configuration.

2. A gliding apparatus according to claim 1, wherein:

the first boot-fastening mechanism comprises two fastening members;

the movable element includes retaining structure arranged to engage with with the fastening members of the first front retaining device when the second front retaining device is in the active configuration.

3. A gliding apparatus according to claim 2, wherein:

the retaining structure and the fastening members are designed to engage with housings provided on the movable element.

4. A gliding apparatus according to claim 2, wherein:

the retaining structure and fastening members are dimensioned such that the first fastening mechanism releases the movable element when the first fastening mechanism is deactivated so as to release the boot.

5. A gliding apparatus according to claim 1, wherein:

the first boot-fastening mechanism includes two fastening members movable transversely in relation to the gliding apparatus and capable of cooperating with two lateral housings arranged on respective sides of the front portion of the sole of the boot.

6. A gliding apparatus according to claim 5, wherein:

each of the boot-fastening members is mounted on an arm designed to rotate or to flex about an axis parallel to the longitudinal axis of the gliding apparatus.

7. A gliding apparatus according to claim 5, wherein:
both of the fastening members are movable only in a single plane transverse to the gliding apparatus.

8. A gliding apparatus according to claim 1, wherein:
the first and second retaining devices are continuously affixed to the gliding board.

9. A gliding apparatus according to claim 1, wherein:
the movable element of the second front retaining device is rotationally and/or translationally movable.

10. A gliding apparatus according to claim 1, wherein:
in the inactive configuration of the second front retaining device, the interface surface is positioned forwardly along the gliding board in relation to the articulation axis, and no element of the second front retaining device rotation of the boot about the articulation axis, by an angle of at least 70°, from a position of the boot supported on the gliding board, when the boot is retained by the first front retaining device.

11. A gliding apparatus according to claim 1, wherein:
in the inactive configuration of the second front retaining device, the movable element of the second front retaining device is positioned rearwardly along the gliding board from the first front retaining device in relation to a position of the movable element in the active configuration of the second front retaining device.

12. A gliding apparatus according to claim 1, wherein:
when the front retaining device is in the active configuration, the interface surface is positioned longitudinally in relation to the first front retaining device, such that no element of the first front retaining device interferes with a lateral release of the front portion of the boot.

13. A gliding apparatus according to claim 12, wherein:
the first front retaining device is capable of partially housing the movable element of the second front retaining device.

14. A gliding apparatus according to claim 1, wherein:
the movable element of the second front retaining device does not incorporate a mechanism for the lateral release of the front portion of the boot.

15. A gliding apparatus according to claim 1, wherein:
the movable element of the second front retaining device is rotationally movable about an axis transverse to a length of the gliding board.

16. A gliding apparatus according to claim 1, wherein:
the second front retaining device is more forwardly positioned on the gliding board than the first front retaining device in both the active configuration and in the inactive configuration.

17. A gliding apparatus according to claim 1, wherein:
in the inactive configuration, the interface surface faces away from the gliding board; and
in the active configuration, the interface surface faces the gliding board.

18. A gliding apparatus according to claim 1, wherein:
the movable element of the second front retaining device is translationally movable.

19. A ski touring binding for fastening a boot of a skier to a ski, said binding comprising:
an ascent toe-piece for engaging and retaining a boot of a user while ascending a slope, the ascent toe-piece comprising a first boot-fastening mechanism, the first boot-fastening mechanism defining an articulation axis about which the boot pivots as a heel of the boot of the user is alternately raised and lowered in relation to the ski during use of the binding while the user ascends the slope;
the ascent toe-piece being selectively configurable into either of the following:
a boot-engaged configuration, for which the boot is fastened to the ascent toe-piece and the boot pivots about a transverse axis while the user ascends the slope; and
a boot-disengaged configuration, for which the boot is free to be selectively released from or inserted into the ascent toe-piece;
a descent toe-piece for engaging and retaining the boot of the user while descending a slope, the descent toe-piece comprising a second boot-fastening mechanism, the second boot-fastening mechanism including a movable element comprising an interface surface designed to come into contact with a front portion of the boot;
the descent toe-piece and the ascent toe-piece being designed to be concurrently mounted on the ski while the skier skis;
the descent toe-piece being selectively configurable into either of the following:
an active boot-engaged configuration, for which the interface surface of the movable element faces downwardly and is designed to be in contact with an upward-facing surface of the front portion of the boot; and
an inactive boot-disengaged configuration, for which the interface surface of the movable element is designed to be out of contact with the front portion of the boot while the ascent toe-piece is in the boot-engaged configuration;
in the inactive configuration, the interface surface of the movable element of the descent toe-piece is designed to face upwardly and away from the ski.

20. A ski touring binding according to claim 19, wherein:
the ascent toe-piece and the descent toe-piece are both mounted on a common mounting plate designed to be supported on the ski.

21. A ski touring binding according to claim 19 in combination with the ski.

22. A ski touring binding for fastening a boot of a skier to a ski, said binding comprising:
an ascent toe-piece for engaging and retaining a boot of a user while ascending a slope, the ascent toe-piece comprising a first boot-fastening mechanism, the first boot-fastening mechanism defining an articulation axis about which the boot pivots as a heel of the boot of the user is alternately raised lowered in relation to the ski during use of the binding while the user ascends the slope;
the ascent toe-piece being selectively configurable into either of the following:
a boot-engaged configuration, for which the boot is fastened to the ascent toe-piece and the boot pivots about a transverse axis while the user ascends the slope; and
a boot-disengaged configuration, for which the boot is free to be selectively released from or inserted into the ascent toe-piece;
a descent toe-piece for engaging and retaining the boot of the user while descending a slope, the descent toe-piece comprising a second boot-fastening mechanism the second boot-fastening mechanism including a movable element comprising a sole-clamp designed to come into contact with a front portion of the boot;
the descent toe-piece and the ascent toe-piece being designed to be concurrently mounted on the ski while the skier skis;
the descent toe-piece being selectively configurable into either of the following:

an active boot-engaged configuration, for which the sole-clamp is designed to be in contact with the front portion of the boot; and an inactive boot-disengaged configuration, for which the sole-clamp is designed to be out of contact with the front portion of the boot while the ascent toe-piece is in the boot-engaged configuration;

in the inactive configuration, in relation to a position in the active configuration, the sole-clamp is in a rearward and lowered position.

23. A ski touring binding according to claim 22, wherein: the second boot-fastening mechanism further comprises a support plate designed to support the boot.

24. A ski touring binding according to claim 23, wherein: in the inactive configuration of the descent toe-piece, the sole-clamp is positioned longitudinally between the ascent toe-piece and the support plate.

25. A ski touring binding according to claim 23, wherein: the second boot-fastening mechanism further comprises a base;

the base includes a housing for the sole-clamp in the inactive configuration of the descent toe-piece.

26. A ski touring binding according to claim 22, wherein: the ascent toe-piece and the descent toe-piece are both mounted on a common mounting plate designed to be supported on the ski.

27. A ski touring binding according to claim 22 in combination with the ski.

* * * * *